US007609223B2

(12) United States Patent
Manasson et al.

(10) Patent No.: US 7,609,223 B2
(45) Date of Patent: Oct. 27, 2009

(54) ELECTRONICALLY-CONTROLLED MONOLITHIC ARRAY ANTENNA

(75) Inventors: Vladimir Manasson, Irvine, CA (US); Vladimir I. Litvinov, Aliso Viejo, CA (US); Lev Sadovnik, Irvine, CA (US); Mark Aretskin, Irvine, CA (US); Mikhail Felman, Tarzana, CA (US); Aramais Avakian, Pasadena, CA (US)

(73) Assignee: Sierra Nevada Corporation, Sparks, NV (US)

( * ) Notice: Subject to any disclaimer, the term of this patent is extended or adjusted under 35 U.S.C. 154(b) by 35 days.

(21) Appl. No.: 11/956,229

(22) Filed: Dec. 13, 2007

(65) Prior Publication Data

US 2009/0153432 A1 Jun. 18, 2009

(51) Int. Cl.
*H01Q 3/24* (2006.01)

(52) U.S. Cl. ..... 343/876; 343/700 MS

(58) Field of Classification Search ..... 343/876, 343/700 MS, 846, 893
See application file for complete search history.

(56) References Cited

U.S. PATENT DOCUMENTS

| | | | | |
|---|---|---|---|---|
| 5,886,670 | A | 3/1999 | Manasson et al. | |
| 6,127,987 | A * | 10/2000 | Maruyama et al. | 343/835 |
| 6,317,095 | B1 * | 11/2001 | Teshirogi et al. | 343/785 |
| 6,587,076 | B2 * | 7/2003 | Fujii et al. | 342/372 |
| 6,737,938 | B2 * | 5/2004 | Kitamori et al. | 333/161 |

FOREIGN PATENT DOCUMENTS

EP 1717903 11/2006

OTHER PUBLICATIONS

International Search Report on corresponding PCT application (PCT/2008/086654) from International Searching Authority (KIPO) dated Jun. 29, 2009.

Written Opinion on corresponding PCT application (PCT/2008/086654) from International Searching Authority (KIPO) dated Jun. 29, 2009.

Manasson et al.; "Monolithic Electronically Controlled Millimeter-Wave Beam-Steering Antenna"; Digest of Papers of 1998 Topical Meeting on Silicon Monolithic Integrated Circuits in RF Systems, Sep. 17-18, 1998, pp. 215- 217.

Manasson et al.; "MMW Scanning Antenna"; *IEEE Aerospace and Electronic Systems Magazine*, vol. 11, No. 10, pp. 29-33, Oct. 1996.

* cited by examiner

*Primary Examiner*—HoangAnh T Le
(74) *Attorney, Agent, or Firm*—Klein, O'Neill & Singh, LLP

(57) ABSTRACT

An electronically controlled monolithic array antenna includes a transmission line through which an electromagnetic signal may be propagated, and a metal antenna element defining an evanescent coupling edge located so as to permit evanescent coupling of the signal between the transmission line and the antenna element. The antenna element includes a conductive ground plate; an array of conductive edge elements defining the coupling edge, each of the edge elements being electrically connected to a control signal source, and each of the edge elements being electrically isolated from the ground plate by an insulative isolation gap; and a plurality of switches, each of which is selectively operable in response to the control signal to electrically connect selected edge elements to the ground plate across the insulative isolation gap so as to provide a selectively variable electromagnetic coupling geometry of the coupling edge.

39 Claims, 5 Drawing Sheets

ELECTRONICALLY-CONTROLLED MONOLITHIC ARRAY ANTENNA

CROSS REFERENCE TO RELATED APPLICATION

Not Applicable

FEDERALLY SPONSORED RESEARCH OR DEVELOPMENT

Not Applicable

BACKGROUND

The present disclosure relates to directional or steerable beam antennas, of the type employed in such applications as radar and communications. More specifically, it relates to a dielectric waveguide antenna, in which an evanescent coupling geometry is controllably altered by switchable elements in an evanescent coupling edge, whereby the geometry of the transmitted and/or received beam is controllably altered to achieve the desired directional beam configuration and orientation.

Steerable antennas, particularly dielectric waveguide antennas, are used to send and receive steerable millimeter wave beams in various types of radar devices, such as collision avoidance radars. In such antennas, an antenna element includes an evanescent coupling edge having a selectively variable coupling geometry. The coupling edge is placed substantially parallel and closely adjacent to a transmission line, such as a dielectric waveguide. As a result of evanescent coupling between the transmission line and the antenna elements, electromagnetic radiation is transmitted or received by the antenna. The shape and direction of the transmitted or received beam are determined by the selected coupling geometry of the evanescent coupling edge, as determined, in turn, by the pattern of electrical connections that is selected for the edge features of the coupling edge. This pattern of electrical connections may be controllably selected and varied by an array switches that selectively connect the edge features. Any of several types of switches integrated into the structure of the antenna element may be used for this purpose, such as, for example, semiconductor plasma switches. See, for example. U.S. Pat. No. 7,151,499 (commonly assigned to the assignee of the present application), the disclosure of which patent is incorporated herein by reference in its entirety. A specific example of an evanescent coupling antenna in which the geometry of the coupling edge is controllably varied by semiconductor plasma switches is disclosed and claimed in the commonly-assigned, co-pending U.S. Patent Application Publication No. 2009/0121804, the disclosure of which is incorporated herein in its entirety.

While the technology disclosed and claimed in the aforementioned U.S. Pat. No. 7,151,499 and Application Publication No. 2009/0121804 are improvements in the state of the art, it would be advantageous to provide still further improvements, such as those that could provide the advantages of lower fabrication costs and reduced parasitic coupling among the several components of the antenna array.

SUMMARY OF THE DISCLOSURE

Broadly, the present disclosure relates to an electronically-controlled monolithic array antenna, of the type including a transmission line through which an electromagnetic signal may be propagated, and a metal antenna element defining an evanescent coupling edge located so as to permit evanescent coupling of the signal between the transmission line and the antenna element, characterized in that the antenna element comprises: a conductive metal ground plate; an array of conductive metal edge elements defining the coupling edge, each of the edge elements being electrically connected to a control signal source, and each of the edge elements being electrically isolated from the ground plate by an insulative isolation gap, and a plurality of switches, each which is selectively operable in response to the control signal to electrically connect selected edge elements to the ground plate across the insulative isolation gap so as to provide a selectively variable electromagnetic coupling geometry for the coupling edge.

The term "selectively variable electromagnetic coupling geometry" is defined, for the purposes of this disclosure, as a coupling edge shape comprising an array of conductive edge elements that can be selectively connected electrically to the ground plate to controllably change the effective electromagnetic coupling geometry of the antenna element. As a result of evanescent coupling between the transmission line and the antenna elements, electromagnetic radiation is transmitted or received by the antenna. The shape and direction of the transmitted or received beam are determined by the selected coupling geometry of the evanescent coupling edge, as determined, in turn, by the pattern of electrical connections that is selected between the edge elements and the ground plate.

As will be appreciated from the following detailed description, a feature of an antenna constructed in accordance with this disclosure that the ground plate or ground plate assembly is isolated from the controlled edge elements except when electrically connected by the switches. This eliminates the need for extra conductors (wires or conductive traces) for delivering current to the switches. This simplifies the overall geometry of the design, leading to lower fabrication costs, while also eliminating any parasitic capacitance that would otherwise be contributed by the extra conductors.

In the preferred embodiments disclosed herein, the electrical connections between the edge elements are selectively varied by the selective actuation of an array of "on-off" switches that close and open electrical connections between selected edge elements and the ground plate. The selection of the "on" or "off" state of the individual switches thus changes the electromagnetic geometry of the coupling edge of the antenna element, and, therefore the direction and shape of the transmitted or received beam. The configuration and patter of the particular edge features are determined by computer modeling, depending on the antenna application, and will be a function of such parameters as the operating frequency (wavelength) of the beam radiation, the required beam pattern and direction, transmission (or reception) efficiency, and operating power. The actuation of the switches may be accomplished under the control of an appropriately-programmed computer, in accordance with an algorithm that may be readily derived for any particular application by a programmer of ordinary skill in the art.

DETAILED DESCRIPTION

Figure 1:
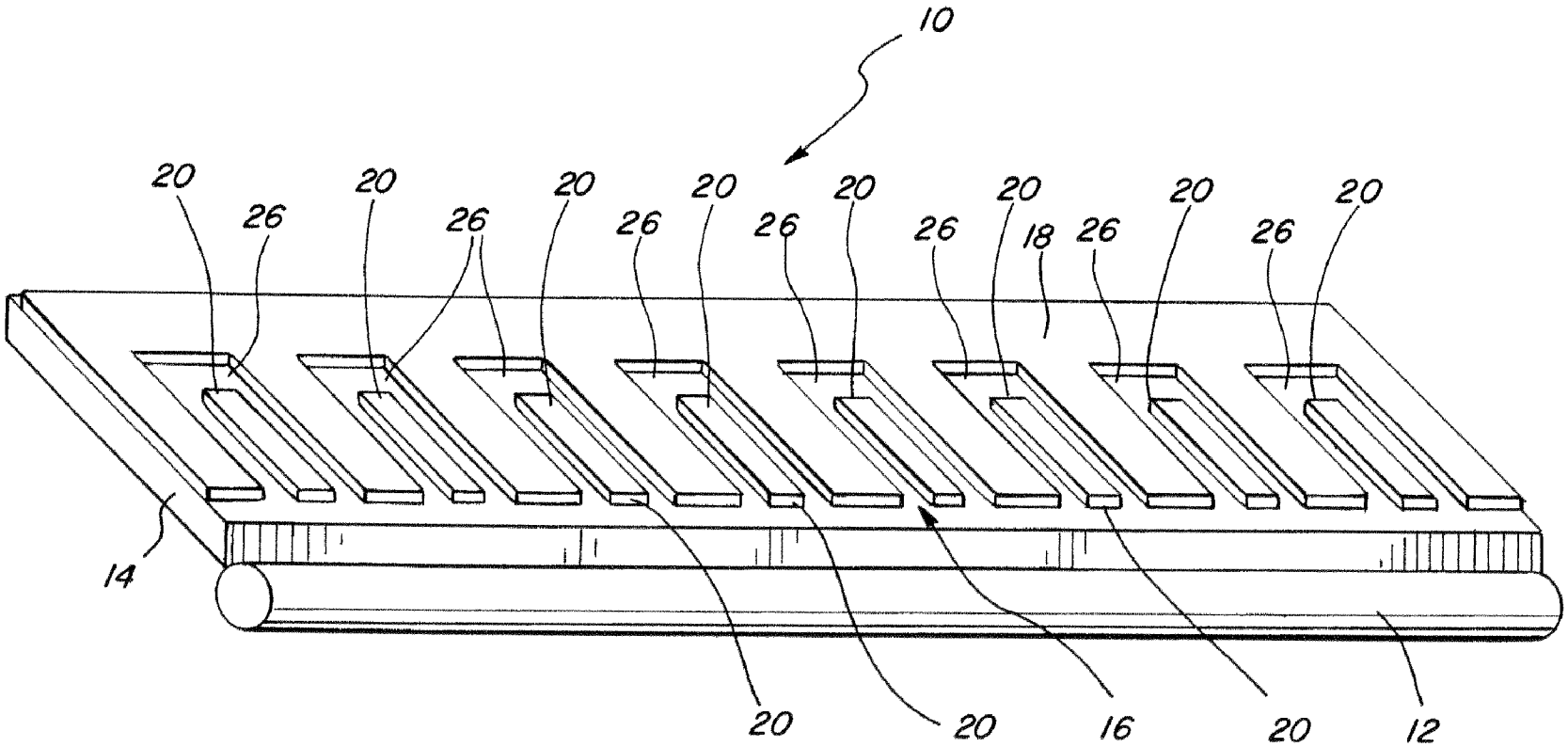
FIG. 1 is a semi-schematic perspective view of the antenna element and transmission line of a first embodiment of an electronically-controlled monolithic array antenna in accordance with the present disclosure, the array of switches being omitted for the sake of clarity.
Figure 2A:
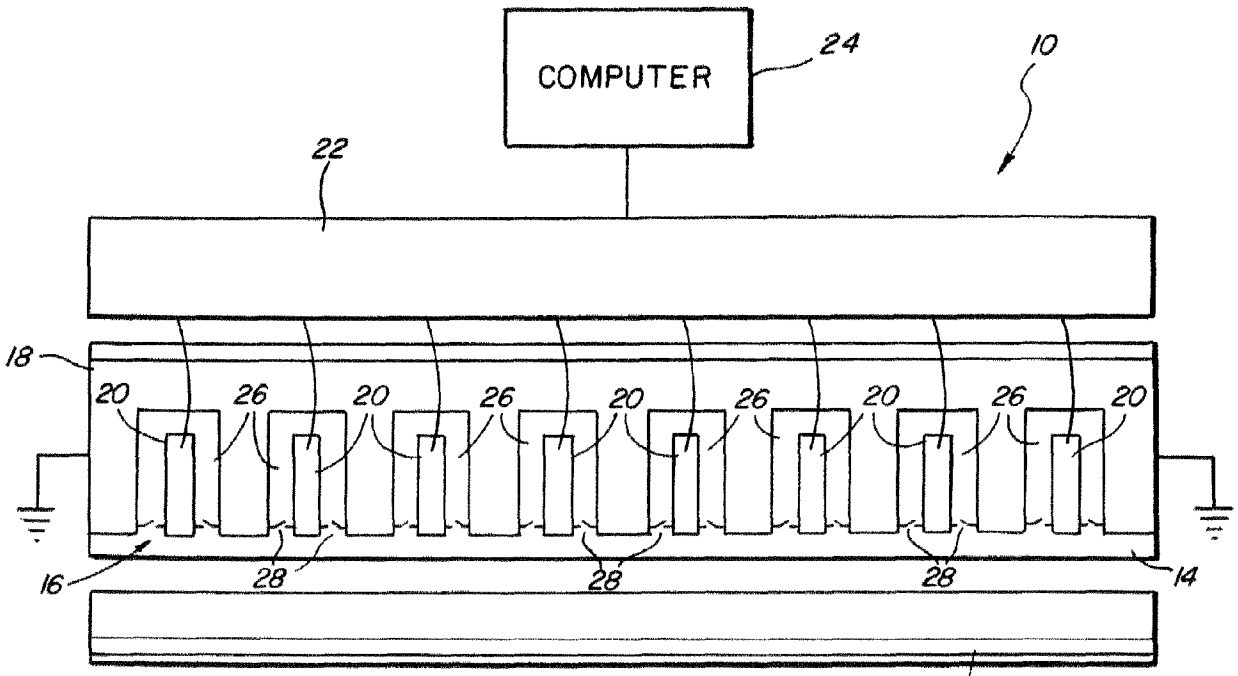
FIG. 2A is a semi-schematic plan view of an electronically-controlled monolithic array antenna in accordance with the embodiment of FIG. 1.
Figure 2B:
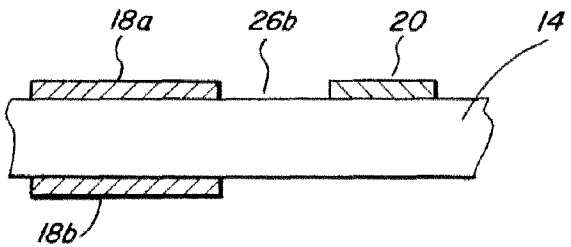
FIG. 2B is a cross-sectional view of an alternative form of the antenna ground plate used in the antenna of FIG. 2A.

FIGS. 1, 2A, and 2B show an electronically-controlled monolithic array antenna 10, comprising a transmission line 12 in the form of a narrow, elongate dielectric rod, and a substrate 14 on which is disposed a conductive metal antenna element that defines an evanescent coupling edge 16, as will be described in detail below, that is aligned generally parallel to the transmission line 12. The antenna element comprises a conductive metal ground plate 18 and a plurality of conductive metal edge elements 20 arranged in a substantially linear array along or near the front edge of the substrate 14 so as to form the coupling edge 16. The alignment of the coupling edge 16 and the transmission line 12, and their proximity to each other, allow the evanescent coupling of electromagnetic radiation between the transmission line 12 and the coupling edge 16, as is well-known in the art. While the transmission line 12 is preferably an elongate, rod-shaped dielectric waveguide, other types of transmission lines may be employed. Examples of such other types of transmission lines include slot lines, coplanar lines, rib waveguides, groove waveguides, imaging waveguides, and planar waveguides.

The substrate 14 may be a dielectric material, such as quartz, sapphire, ceramic, a suitable plastic, or a polymeric composite. Alternatively, the substrate 14 may be a semiconductor, such as silicon, gallium arsenide, gallium phosphide, germanium, gallium nitride, indium phosphide, gallium aluminum arsenide, or SOI (silicon-on-insulator). The antenna element (comprising the ground plate 18 and the edge elements 20) may be formed on the substrate 14 by any suitable conventional method, such as electrodeposition or electroplating, followed by photolithography (masking and etching). If the substrate 14 is made of a semiconductor, it may be advantageous to apply a passivation layer (not shown) on the surface of the substrate before the antenna element 18, 90 is formed.

As shown in FIG. 2A, in the antenna 10, the ground plate 18 is connected to ground or is maintained at a suitable, fixed reference potential. The edge elements 20 are individually connected to a control signal source 22, which may be a controllable current source. The control signal source 22 may be under the control of an appropriately programmed computer or microprocessor 24 in accordance with an algorithm that may be readily derived for any particular application by a programmer of ordinary skill in the art.

Figure 3:
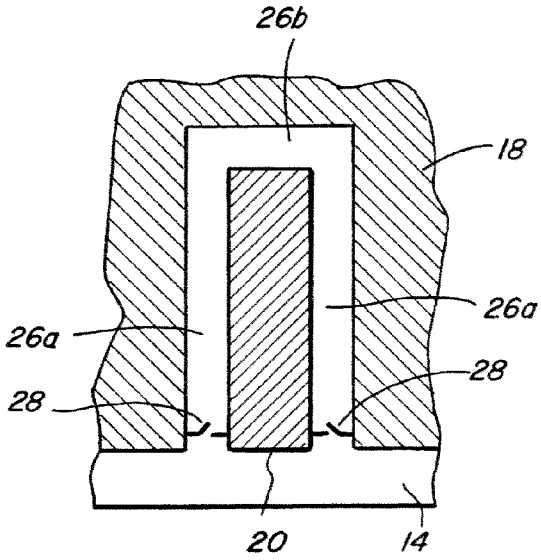
FIGS. 3-6 are detailed plan views of several different edge element, ground plate, and switch configurations that may be employed in an antenna in accordance with the embodiment of FIGS. 1, 2A, and 2B.

Each of the edge elements 20 is physically and electrically isolated from the ground plate 18 by an insulative isolation gap 26. Thus, each of the edge elements 20 is in the form of a conductive "island" surrounded on three sides by the ground plate 18, with the fourth side facing the transmission line 12 and forming a part of the coupling edge 16. As best shown in FIG. 3, in an exemplary embodiment, each of the insulative isolation gaps 26 comprises a pair of parallel gap segments 26*a* connected by a transverse gap segment 26*b*, with the parallel gap segments being substantially perpendicular to the coupling edge 16.

FIG. 2B shows that the ground plate may be a multi-element ground plate, comprising a first ground plate element 18*a* on the upper surface of the substrate 14, and a second ground plate element 18*b* on the lower surface of the substrate 14. In this context, the upper surface is the surface on which the edge elements 20 are disposed, and the lower surface is the opposite surface.

The coupling geometry of the coupling edge 16 is controllably varied by a plurality of switches 28 (FIGS. 2A and 3), each of which may be selectively actuated to electrically connect one of the edge elements 20 to the ground plate 18 across one of the insulative isolation gaps 26. In the exemplary embodiment of FIGS. 1, 2A, and 3, a switch 28 is disposed across each of the parallel gap segments 26*a* near the coupling edge 16, so that each of the edge elements 20 is connectable to the ground plate 18 by two beam-directing switches 28: one switch across each of the parallel gap segments 26*a* on either side of the edge element 20.

The switches 28 may be any suitable type of micro-miniature switch that can incorporated on or in the substrate 14. For example, the switches 28 can be semiconductor switches (e.g., PIN diodes, bipolar transistors. MOSFETs, or heterojunction bipolar transistors), MEMS switches, piezoelectric switches, capacitive switches (such as varactors), lumped IC switches, ferro-electric switches, photoconductive switches, electromagnetic switches, gas plasma switches, and semiconductor plasma switches.

In one exemplary embodiment, best shown in FIGS. 2A and 3, each of the switches 28 is located near the open end of its associated parallel gap segment 26*a*; that is, close to the coupling edge 16. The parallel gap segments 26*a* function as slotlines through which electromagnetic radiation of a selected effective wavelength (in the slotline medium) $\lambda$ propagates. If the length of the parallel gap segments 26*a* is $\lambda/4$, the phase angle $\phi$ of the output wave at the coupling edge 16 is $2\pi$ radians at the outlet (open end) of any parallel gap segment 26*a* for which the associated switch 28 is open. For any parallel gap segment 26*b* for which the associated switch is closed (effectively grounding the edge element 20), the phase angle $\phi$ of the output wave at the coupling edge is $\pi$ radians. Typically, in operation, the switches 28 will be selectively opened and closed to create a diffraction grating with a period P=N+M, comprising N parallel gap segments or slotlines 26*a* with open switches 28, followed by M parallel gap segments or slotlines 26*a* with closed switches 28. Viewed another way, the grating period P will comprise N slotlines providing a coupling edge phase angle $\phi$ of $2\pi$ radians, followed by M slotlines providing a coupling edge phase angle $\phi$ of $\pi$ radians. Thus, the grating period P will be the distance between the first of the N "open" slotlines and the last of the M "closed" slotlines. The resultant beam angle $\alpha$ will thereby be given by the formula:

$$\sin \alpha = \beta/k - \lambda/Pd, \qquad 1.$$

where $\beta$ is the wave propagation constant in the transmission line 12, k is the wave vector in a vacuum, $\lambda$ is the effective wavelength of the electromagnetic radiation propagating through the medium of the slotlines 26*a*, and d is the spacing between adjacent antenna edge elements 20.

It will be seen from the foregoing formula that by selectively opening and closing the switches 28, the grating period P can be controllably varied, thereby controllably changing the beam angle α of the electromagnetic radiation coupled between the transmission line 12 and the antenna element 18, 20.

Figure 4:
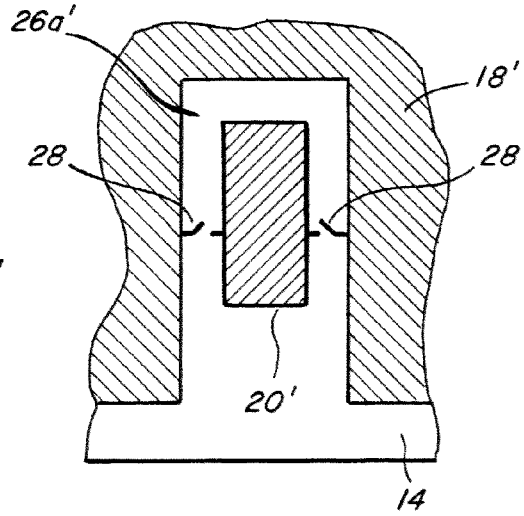
Figure 5:
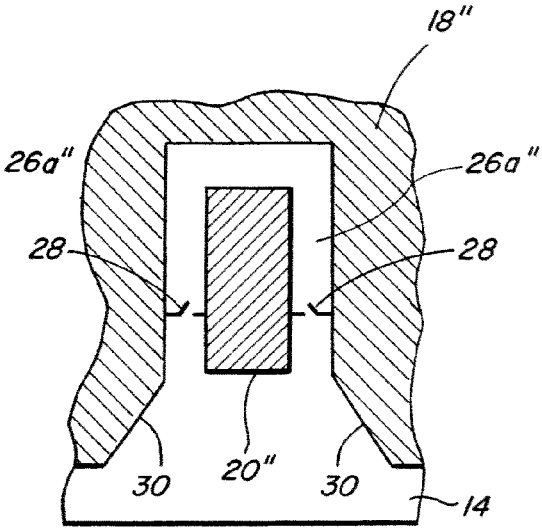
Figure 6:
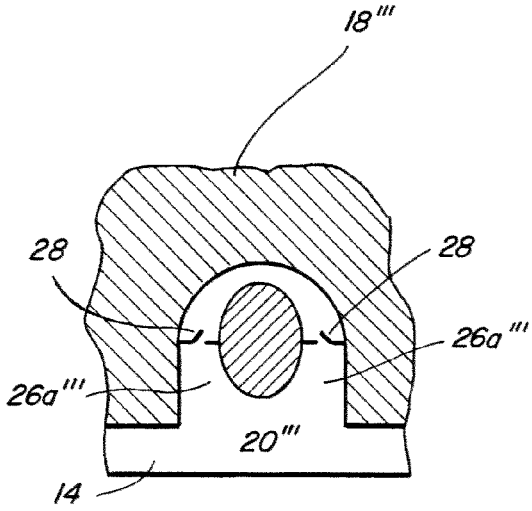

FIGS. 4, 5, and 6 illustrate alternative configurations for the antenna element and the beam-directing switches. Specifically, FIG. 4 shows an antenna element comprising a ground plate 18' and edge elements 20' (only one of which is illustrated), wherein the edge elements 20' are configured so as to provide a coupling edge that is recessed from the front edge of the ground plate 18'. Consequently, the edge elements 20 are isolated from the ground plate 18' by parallel isolation gap segments or slotlines 26*a*' that are shorter than in the previously-described configuration (shown, for example, in FIG. 3). The slotlines 26*a*' may therefore have a length that is other than λ/4, thereby providing an alternative phase angle for the output wave at the "open" slotlines. In addition, this configuration shows that the beam-directing switches 28 may be placed at various locations along the length of the slotlines 26*a*, such as, for example at a position that is a distance of λ/2 from the front end of the slotline 26*a*' (i.e. from the coupling edge), again for the purpose of providing different phase angles. FIG. 5 shows a similar configuration, in which a ground plate 18" is provided that forms an angled entrance 30 for the slotlines 26*a*", the purpose of which is to provide enhanced coupling between the transmission line 12 and the antenna edge element 20. FIG. 6 shows a configuration with edge elements 20''' (only one of which is shown) that may be elliptical or any other regular shape, with a ground plate 18''' and parallel isolation gap segments or slotlines 26*a*''' that are correspondingly shaped.

Figure 7:
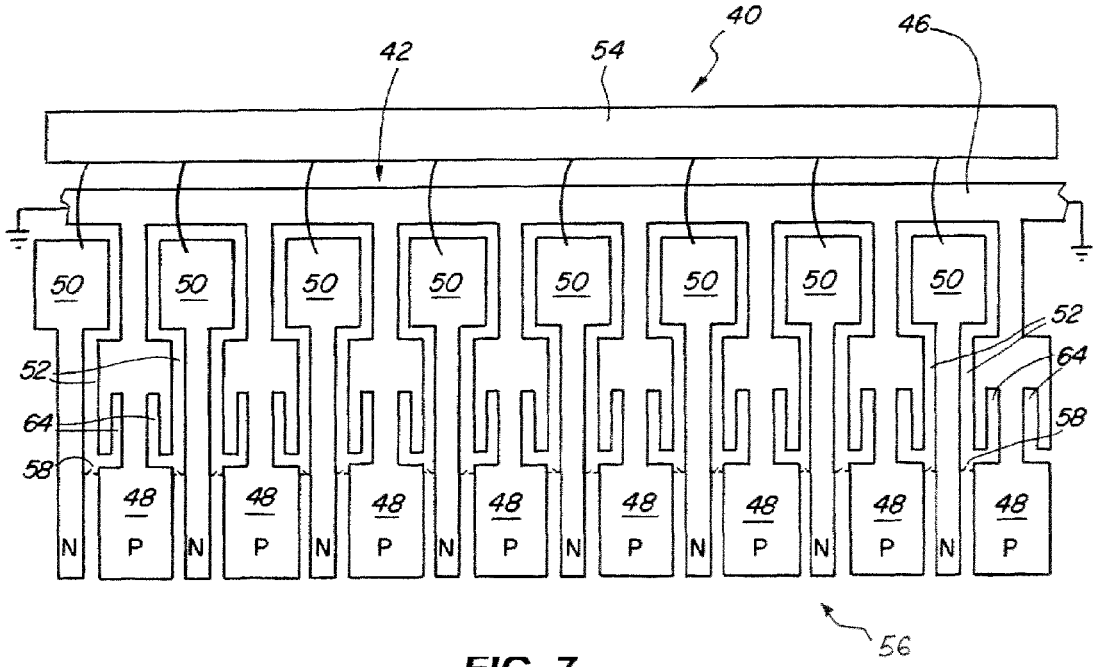
FIG. 7 is a semi-schematic plan view of a second embodiment of an electronically-controlled monolithic array antenna in accordance with the present disclosure, the transmission line being omitted for the sake of clarity.
Figure 7A:
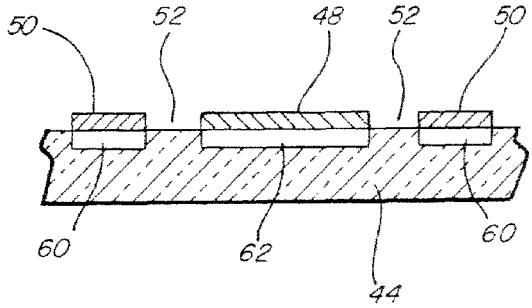
FIG. 7A is a cross-sectional view of the embodiment of FIG. 7.

FIGS. 7 and 7A illustrate an antenna 40 in accordance with a second exemplary embodiment, the transmission line being omitted for clarity. In this embodiment, a conductive metal ground plate 42 is formed on a substrate 44, which in this exemplary embodiment may be a semiconductor, such as silicon. The ground plate 42 is maintained at ground or at a fixed reference voltage, and it includes a substantially linear ground conductor 46 extending along the back edge of the substrate 44, and a plurality of transverse ground element fingers 48 extending from the linear conductor 46 toward the front edge of the substrate 44. The ground element fingers 48 are interdigitated by a plurality of edge element fingers 50, with an isolation gap or slotline 52 separating each of the edge element fingers 50 from the adjacent ground element finger 48 on either side. Each of the edge element fingers 50 is connected to a control signal source 54, and the plurality of edge element fingers forms a coupling edge 56, as described above with reference to FIGS. 1 and 2A. A beam-directing switch 58 switchably connects each of the edge element fingers 50 to an adjacent ground element finger 48 across the intervening isolation gap or slotline 52.

As shown in FIG. 7A, the switches 58 may advantageously (but not necessarily) be semiconductor plasma switches. If the switches 58 are semiconductor plasma switches, then each switch 58 comprises an N-doped region 60 in the substrate 44, underlying and in contact with an edge element finger 50, and a P-doped region 62 in the substrate, underlying and in contact with a ground element finger 48. Thus, each switch 58 is provided by a PIN junction comprising a P-electrode formed by a ground element finger 48, an N-electrode formed by an edge element finger 50, and the intervening insulative isolation gap/slotline 52. To assure that isolation gap/slotline 52 is sufficiently insulative to form a functional PIN junction, it may be advantageous to provide an insulative passivation layer (not shown) on the substrate 44 in the isolation gaps/slotlines 52. It will be understood that the switches 58 shown in FIG. 7 are schematically represented, as the switching function is provided along a substantial portion of lengths of the ground element fingers 48 and the edge element fingers 50, and not at a specific point as shown.

As shown in FIG. 7, each of the isolation gaps 52 may have a total length that is considerably longer than λ/4. To limit the length of the slotline provided by each isolation gap 52 to a specific length (e.g., λ/4), each isolation gap 52 may advantageously be configured with a main portion in which one of the switches 58 is operable, and a branch portion 64 extending into an adjacent ground element finger 50, whereby each ground element finger 50 is configured with an isolation gap/slotline branch portion 64 on either side. The branch portions 64 serve as "chokes" that short the edge elements 50 to the ground plate 48 at the coupling edge when the switches 58 are open. Thus, if a switch 58 for a particular isolation gap 52 is closed, the length of the slotline provided by that isolation gap will be the distance from the switch to the coupling edge. If a switch 58 for a particular isolation gap 52 is open, the "choke" provided by the branch portion 64 will effectively "short" the edge element 50 to ground at the coupling edge. By way of specific example, if the distance between each of the switches 58 and the coupling edge is λ/4, the branch portions 64 may advantageously have a length that is approximately λ/4, thereby providing a coupling edge phase angle ϕ of π radians for any isolation gap/slotline 52 for which the associated switch 58 is open. If the switch 58 is closed, the coupling edge phase angle ϕ will be 2π radians.

Figure 8:
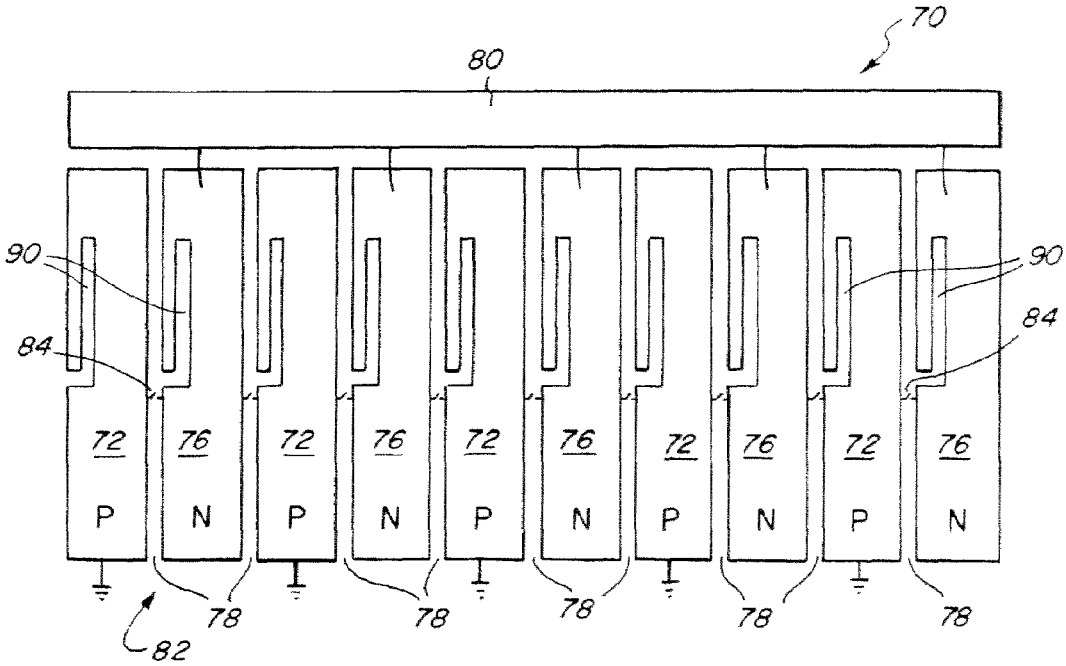
FIG. 8 is a semi-schematic plan view of a third embodiment of an electronically-controlled monolithic array antenna in accordance with the present disclosure, the transmission line being omitted for the sake of clarity.
Figure 8A:
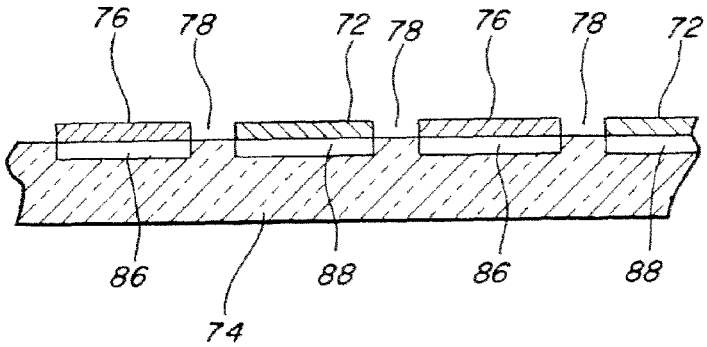
FIG. 8A is a cross-sectional view of the embodiment of FIG. 8

FIGS. 8 and 8A illustrate an antenna 70 in accordance with a third exemplary embodiment, the transmission line being omitted for clarity. In this embodiment, a ground plate assembly comprises a plurality of conductive metal ground elements 72 is formed on a substrate 74, which in this exemplary embodiment, may be a semiconductor, such as silicon. The ground elements 72 are maintained at ground or at a fixed reference voltage. The ground elements 72 are interdigitated by a plurality of edge elements 76, with an isolation gap or slotline 78 separating each of the edge elements 76 from the adjacent ground element 72 on either side. Each of the edge elements 76 is connected to a control signal source 80, and the plurality of edge elements 76 forms a coupling edge 82, as described above with reference to FIGS. 1 and 2A. A beam-directing switch 84 switchably connects each of the edge elements 76 to an adjacent ground element 72 across the intervening isolation gap or slotline 78.

As shown in FIG. 8A, the switches 84 may advantageously (but not necessarily) be semiconductor plasma switches. If the switches 84 are semiconductor plasma switches, then each switch 84 comprises an N-doped region 86 in the substrate 74, underlying and in contact with an edge element 76, and a P-doped region 88 in the substrate 74, underlying and in contact with a ground element 72. Thus, each switch 84 is provided by a PIN junction comprising a P-electrode formed by a ground element 72, an N-electrode formed by an edge element 76, and the intervening insulative isolation gap/slotline 78. To assure that isolation gap/slotline 78 is sufficiently insulative to form a functional PIN junction, it may be advantageous to provide an insulative passivation layer (not shown) on the substrate 74 in the isolation gaps/slotlines 78. It will be understood that the switches 84 shown in FIG. 8 are schematically represented, as the switching function is provided along a substantial portion of lengths of the ground elements 72 and the edge elements 76, and not at a specific point as shown.

As shown in FIG. 8, each of the isolation gaps/slotlines 78 may advantageously be configured with a main portion across which one of the switches 84 is operable, and a branch portion 90 extending into an adjacent ground element 72 or edge element 76, whereby each ground element 72 and each edge element 76 is configured with an isolation gap/slotline branch portion 90. The branch portions 90 serve the same function as described above for the branch portions 64 in the embodiment of FIGS. 7 and 7A.

While several exemplary embodiments have been described herein, it will be understood that the scope of this disclosure and of any rights claimed therein is not limited by these embodiments. Indeed, it will be apparent to those skilled in the pertinent arts that a number of modifications and variations of the disclosed embodiments may suggest themselves, and that such variations and modifications will fall within the spirit and scope of this disclosure. Accordingly, the rights defined by the claims that follow should be construed in light of any such equivalents that may suggest themselves to those skilled in the pertinent arts.

What is claimed is:

1. An electronically controlled monolithic array antenna, of the type including a transmission line through which an electromagnetic signal may be propagated, and a metal antenna element defining an evanescent coupling edge located so as to permit evanescent coupling of the signal between the transmission line and the antenna element, characterized in that the antenna element comprises:

a conductive metal ground plate;

an array of conductive metal edge elements defining the coupling edge, each of the edge elements being electrically connected to a control signal source, and each of the edge elements being electrically isolated from the ground plate by an insulative isolation gap; and a plurality of switches, each of which is selectively operable in response to the control signal to electrically connect selected edge elements to the ground plate across the insulative isolation gap so as to provide a selectively variable electromagnetic coupling geometry of the coupling edge.

2. The antenna of claim 1, wherein the control signal is generated in accordance with a computer program.

3. The antenna of claim 1, wherein the transmission line is selected from the group consisting of at least one of a dielectric waveguide, a slot line, a coplanar line, a rib waveguide, a groove waveguide, and an imaging waveguide.

4. The antenna of claim 1, wherein the switches are selected from the group consisting of at least one of PIN diodes, bipolar transistors, MOSFETs, HBTs, MEMS switches, piezoelectric switches, photoconductive switches, capacitive switches, lumped IC switches, ferro-electric switches, electromagnetic switches, gas plasma switches, and semiconductor plasma switches.

5. The antenna of claim 1, wherein the ground plate and the edge elements are formed on a substrate.

6. The antenna of claim 5, wherein the substrate is made of a material selected from the group consisting of at least one of a dielectric material and a semiconductor material.

7. The antenna of claim 6, wherein the substrate is a dielectric material selected from the group consisting of at least one of quartz, sapphire, ceramic, plastic, and a polymeric composite.

8. The antenna of claim 6, wherein the substrate is a semiconductor material selected from the group consisting of at least one of silicon, gallium arsenide, gallium phosphide, germanium, gallium nitride, indium phosphide, gallium aluminum arsenide, and SOI.

9. The antenna of claim 1, wherein the ground plate comprises a plurality of ground plate elements, each of which is separated from any adjacent edge elements by an insulative isolation gap.

10. The antenna of claim 1, wherein the electromagnetic signal has an effective wavelength $\lambda$ in the insulative isolation gap, and wherein the insulative isolation gap has a length that has a predefined relationship with $\lambda$.

11. The antenna of claim 10, wherein the insulative isolation gap has a length of approximately $\lambda/4$.

12. The antenna of claim 10, wherein each of the insulative isolation gaps includes a main portion across which one of the switches is operable, and a branch portion having a length of approximately $\lambda/4$.

13. The antenna of claim 5, wherein the substrate has first and second surfaces, and wherein the ground plate comprises a first ground plate element on the first surface and a second ground plate element on the second surface.

14. An electronically controlled monolithic array antenna, comprising:

a substrate having a front edge;

a dielectric transmission line through which an electromagnetic signal may be propagated, the transmission line being located substantially parallel to the front edge of the substrate;

an array of conductive edge elements provided along the front edge of the substrate, the edge elements defining an evanescent coupling edge located so as to permit evanescent coupling of the signal between the transmission line and the edge elements;

a control signal source electrically coupled to each of the edge elements;

a ground plate located on the substrate so as to be separated from each of the edge elements by an insulative isolation gap; and a plurality of switches provided between the edge elements and the ground plate, each of the switches being selectively operable in response to the control signal to electrically connect selected edge elements to the ground plate across the insulative isolation gap so as to provide a selectively variable electromagnetic coupling geometry for the coupling edge.

15. The antenna of claim 14, wherein the ground plate comprises a plurality of ground plate elements, each of which is separated from any adjacent edge elements by an insulative isolation gap.

16. The antenna of claim 14, wherein the control signal is generated in accordance with a computer program.

17. The antenna of claim 14, wherein the transmission line is selected from the group consisting of at least one of a dielectric waveguide, a slot line, a coplanar line, a rib waveguide, a groove waveguide, and an imaging waveguide.

18. The antenna of claim 14, wherein the switches are selected from the group consisting of at least one of PIN diodes, bipolar transistors. MOSFETs, HBTs, MEMS switches, piezoelectric switches, photoconductive switches, capacitive switches, lumped IC switches, ferro-electric switches, electromagnetic switches, gas plasma switches, and semiconductor plasma switches.

19. The antenna of claim 14, wherein the ground plate and the edge elements are formed on a substrate.

20. The antenna of claim 19, wherein the substrate is made of a material selected from the group consisting of at least one of a dielectric material and a semiconductor material.

21. The antenna of claim 20, wherein the substrate is a dielectric material selected from the group consisting of at least one of quartz, sapphire, ceramic, plastic, and a polymeric composite.

22. The antenna of claim 20, wherein the substrate is a semiconductor material selected from the group consisting of at least one of silicon, gallium arsenide, gallium phosphide, germanium, gallium nitride, indium phosphide, gallium aluminum arsenide, and SOI.

23. The antenna of claim 14, wherein the electromagnetic signal has an effective wavelength $\lambda$ in the insulative isolation gap, and wherein the insulative isolation gap has a length that has a predefined relationship with $\lambda$.

24. The antenna of claim 23, wherein the insulative isolation gap has a length of approximately $\lambda/4$.

25. The antenna of claim 23, wherein each of the insulative isolation gaps includes a main portion across which one of the switches is operable, and a branch portion having a length of approximately $\lambda/4$.

26. The antenna of claim 19, wherein the substrate has first and second surfaces, and wherein the ground plate comprises a first ground plate element on the first surface and a second ground plate element on the second surface.

27. An electronically controlled monolithic array antenna, comprising:

a dielectric transmission line through which an electromagnetic signal may be propagated;

an antenna element having an evanescent coupling edge located with respect to the transmission line so as to allow evanescent coupling of the signal between the antenna element and the transmission line, the antenna element comprising:

a plurality of conductive coupling edge elements electrically connected to a control signal source;

a ground plate separated from each of the edge elements by an insulative isolation gap defining a slotline; and an array of switches operable in response to the control signal to selectively connect selected ones of the edge elements to the ground plate across an associated isolation gap to thereby provide a selectively variable coupling geometry for the coupling edge, wherein the coupling geometry comprises a first number of slotlines providing a first coupling edge phase angle, followed by a second number of slotlines providing a second coupling edge phase angle, wherein first and second numbers of slotlines are selectively varied by the switches in response to the control signal.

28. The antenna of claim 27, wherein the control signal is generated in accordance with a computer program.

29. The antenna of claim 27, wherein the transmission line is selected from the group consisting of at least one of a dielectric waveguide, a slot line, a coplanar line, a rib waveguide, a groove waveguide, and an imaging waveguide.

30. The antenna of claim 27, wherein the switches are selected from the group consisting of at least one of PIN diodes, bipolar transistors, MOSFETs, HBTs, MEMS switches, piezoelectric switches, photoconductive switches, capacitive switches, lumped IC switches, ferro-electric switches, electromagnetic switches, gas plasma switches, and semiconductor plasma switches.

31. The antenna of claim 27, wherein the ground plate and the edge elements are formed on a substrate.

32. The antenna of claim 31, wherein the substrate is made of a material selected from the group consisting of at least one of a dielectric material and a semiconductor material.

33. The antenna of claim 32, wherein the substrate is a dielectric material selected from the group consisting of at least one of quartz sapphire, ceramic, plastic, and a polymeric composite.

34. The antenna of claim 32, wherein the substrate is a semiconductor material selected from the group consisting of at least one of silicon, gallium arsenide, gallium phosphide, germanium, gallium nitride, indium phosphide, gallium aluminum arsenide, and SOI.

35. The antenna of claim 27, wherein the ground plate comprises a plurality of ground plate elements, each of which is separated from any adjacent edge elements by an insulative isolation gap.

36. The antenna of claim 27, wherein the electromagnetic signal has an effective wavelength $\lambda$ in the insulative isolation gap, and wherein the insulative isolation gap has a length that has a predefined relationship with $\lambda$.

37. The antenna of claim 36, wherein the insulative isolation gap has a length of approximately $\lambda/4$.

38. The antenna of claim 36, wherein each of the insulative isolation gaps includes a main portion across which one of the switches is operable, and a branch portion having a length of approximately $\lambda/4$.

39. The antenna of claim 31, wherein the substrate has first and second surfaces, and wherein the ground plate comprises a first ground plate element on the first surface and a second ground plate element on the second surface.

* * * * *